United States Patent [19]

Tosswill

[11] Patent Number: 4,608,519

[45] Date of Patent: Aug. 26, 1986

[54] MIDDLE-INFRARED IMAGE INTENSIFIER

[75] Inventor: Christopher H. Tosswill, Sturbridge, Mass.

[73] Assignee: Galileo Electro-Optics Corp., Sturbridge, Mass.

[21] Appl. No.: 596,935

[22] Filed: Apr. 5, 1984

[51] Int. Cl.[4] ..... H01J 43/06

[52] U.S. Cl. ..... 313/528; 313/529; 313/103 CM; 313/105 CM

[58] Field of Search ..... 250/213 VI, 338 R, 332; 313/103 CM, 105 CM, 525, 528, 529, 534, 537

[56] References Cited

U.S. PATENT DOCUMENTS 3,188,467 6/1965 Weissenberg ..... 250/213 VT X
3,333,133 7/1967 Morton et al. ..... 513/529 X
4,131,818 12/1978 Wilder ..... 313/528 X
4,339,659 7/1982 Johnson ..... 313/528 X

*Primary Examiner*—David K. Moore
*Assistant Examiner*—K. Wieder

[57] ABSTRACT

A middle-infrared image intensifier including an image-forming microchannel plate having an input face with a photoconductor material that is activated by middle-infrared radiation, means for flooding electrons to a region adjacent to the input face of the photoconductor, an electron sensitive light emitting screen positioned to receive electrons from the output face of the microchannel plate, and means for activating the microchannel plate to multiply electrons in channels of the microchannel plate having middle-infrared radiation incident thereon.

8 Claims, 5 Drawing Figures

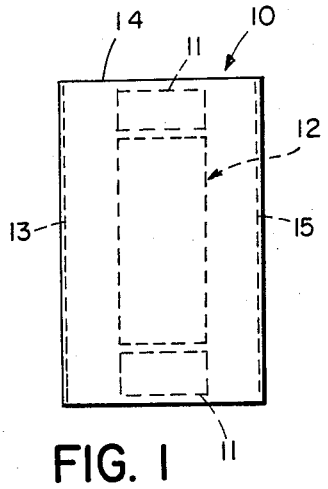
FIG. 1
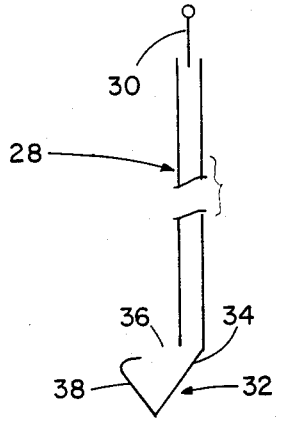
FIG. 3
FIG. 2
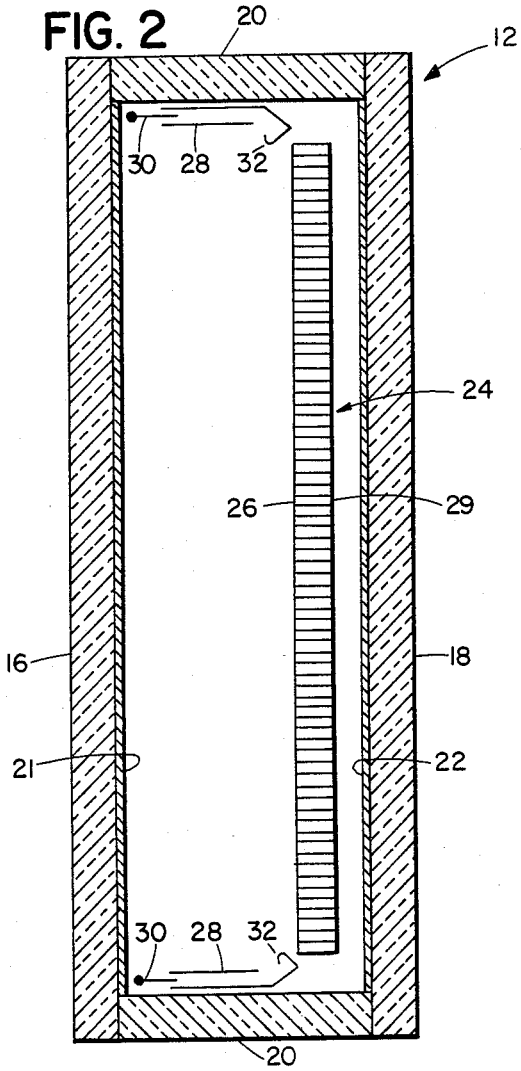
FIG. 2A
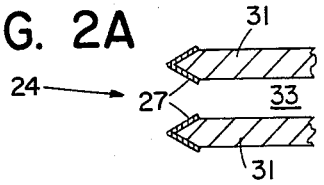
FIG. 4
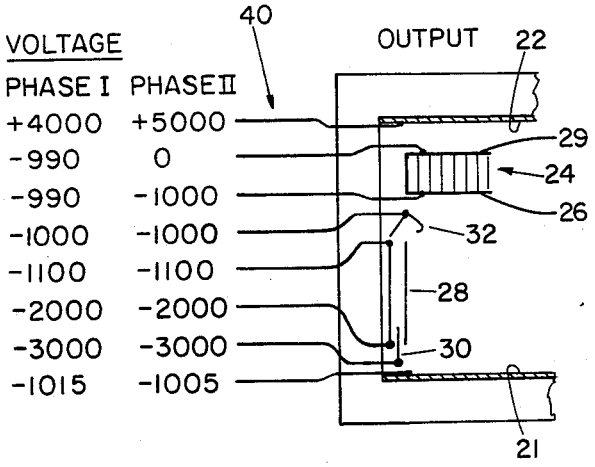

MIDDLE-INFRARED IMAGE INTENSIFIER

FIELD OF THE INVENTION

The invention relates to middle-infrared image intensifiers.

BACKGROUND OF THE INVENTION

Present direct-view, night-vision, image intensifiers employ photoelectron emission for the primary photodetection process, and thus are limited to visible or near-infrared wavelengths not greater than one micron, e.g., provided by moonlight or starlight, in order to obtain the energy necessary for photoelectron emission. In these device microchannel plates are typically used to amplify the electrons, which are then provided to a phosphor screen, to provide a visible image.

Imaging systems for middle-infrared radiation (i.e., resulting from heat), which has insufficient energy for photoelectron emission, are indirect, employing arrays of photoconductors connected to display devices by pluralities of wires. These systems are thus complicated, large, heavy, and expensive.

SUMMARY OF THE INVENTION

I have discovered that a middle-infrared image intensifier can be provided by an image-forming microchannel plate having an input face with a photoconductor that is activated by middle-infrared radiation, means for flooding slow electrons to a region adjacent to the input face of the microchannel plate, and means for activating the microchannel plate to multiply electrons in the channels of the MCP having middle-infrared radiation incident thereon.

In preferred embodiments the microchannel plate is cyclically activated and deactivated while the photoconductor is cyclically brought to a lower voltage at which electrons do not enter the channels of the microchannel plate and then permitted to rise in voltage where the middle-infrared radiation is incident, permitting electrons to enter the channels and be multiplied; the means for flooding electrons is a channel electron multiplier; the region adjacent to the microchannel plate is partially defined by an input window having coated on the input surface a conductive layer maintained at a voltage to limit the energy of the electrons; and the photoconductor is mercury cadmium telluride, and there is a cooling system to maintain the image intensifier at about 80° K.

DESCRIPTION OF THE PREFERRED EMBODIMENT

The structure and operation of the presently preferred embodiment of the invention will now be described, after first briefly describing the drawings.

DRAWINGS

FIG. 1 is a diagrammatic side view of a night-vision device according to the invention.

FIG. 2 is a diagrammatic vertical sectional view of a middle-infrared image intensifier tube of the FIG. 1 device.

FIG. 2A is an enlarged diagrammatic vertical sectional view of a portion of a microchannel plate component of the FIG. 2 image intensifier tube.

FIG. 3 is a diagrammatic vertical elevation of a component of the FIG. 2 image intensifier tube.

FIG. 4 is a diagram showing voltages applied to components of the FIG. 2 image intensifier tube in different phases during operation of the FIG. 1 device.

STRUCTURE

Referring to FIG. 1, there is shown night-vision device 10, which is cylindrical and has a horizontal longitudinal axis. Device 10 includes concentric cylindrical image intensifier tube 12 within housing 14 and doughnut-shaped cooling system 11, to maintain the temperature of tube 12 at approximately 80° K. through the use of liquid nitrogen or Joule-Thomson cooling principles. Input window 13 and output window 15 are separated from tube 12 by evacuated regions to provide insulation.

Referring to FIG. 2, it is seen that image intensifier tube 12 includes circular input window 16, circular output window 18, and cylindrical housing 20 therebetween, all made of glass and sealed to one another. On the interior surface of input window 16 is middle-infrared-transparent, electrically-conducting film 21. On the interior surface of output window 18 is coated phosphor screen 22. Mounted in front of phosphor screen 22 is microchannel plate 24, the input face 26 of which is coated with mercury cadmium telluride material 27 (FIG. 2A), a photoconductor that is activated by middle-infrared radiation incident on it. (By middle-infrared radiation I mean radiation having wavelengths between 1 and 20 microns. Mercury cadmium telluride, e.g., is very sensitive to wavelengths about 10 microns.) Output face 29 of microchannel plate 24 faces phosphor screen 22 to direct electrons to it. FIG. 2A shows material 27 at the entrances to channels 33 between walls 31 of microchannel plate 24.

Channel electron multipliers 28 are positioned near housing 20. (Channel electron multipliers 28 are shown diagrammatically positioned at the top and bottom in FIG. 2; in the preferred embodiment there are three channel electron multipliers equally spaced around the inside of cylindircal housing 20). Channel electron multipliers 28 act as electron generators Associated with channel electron multipliers 28 are field emitters 30, the primary source of electrons. At the ends of channel electron multipliers 28 near microchannel plate 24 are anodes 32, shown in detail in FIG. 3. Each anode 32 includes two segments: first segment 34, coated with a low-resistance surface material possessing a high secondary emission coefficient to provide low-energy electrons through slot aperture 36, and second segment 38, coated with a low secondary emission coefficient material and positioned and shaped to trap the primary electrons reflected from segment 34.

Night vision device 10 also includes a power supply and switching means (not shown) to provide voltages to the various elements of image-intensifier tube 12 over leads 40 diagrammatically shown in FIG. 4 and described in more detail below.

OPERATION

In operation, the middle-infrared image to be viewed is focused on input face 26 of microchannel plate 24 through a permanent lens system (not shown), and tube 12 is cyclically operated through two-phases of 10 ms duration each at a rate of fifty cycles per second to provide electrons creating a flicker-free visible image on phosphor screen 22. As is shown in FIG. 4, the voltages applied to film 21, input face 26, output face 29, and phosphor screen 22 are different in Phase I and Phase II, while the voltages applied to field emitter 30, the inlets and outlets of channel electron multipliers 28 and channel electron multiplier anodes 32 are maintained at the same values during both Phases I and II.

During both Phase I and II, a flood of electrons is provided to the region adjacent to input face 26 by channel electron multipliers 28. Because the electrons would normally leave channel electron multipliers 28 with energies ranging from a few electron volts up to approximately 100 electron volts, anode 32 is used to narrow the electron energy spectrum to low levels useful with voltage changes occurring in the photoconductor. First segment 34 has a high secondary emission coefficient; primary electrons from multiplier 28 are absorbed by it, and low-energy electrons (energies up to 15 electron volts) are emitted and supplied through aperture 36. Segment 38 serves as a Faraday cup, trapping high-energy primary electrons reflected from the surface of segment 34.

During Phase I, flood electrons from anode 32 are collected on photoconductor material 27, establishing a potential that is 10 volts less than that at the microchannel plate surface underlying the photoconductor material irrespective of the level of infrared radiation incident on plate 24. This is because anode 32 is maintained at −1,000 volts, and the surface underlying the photoconductor material is maintained at −990 volts. In Phase I output face 29 of microchannel plate 24 is maintained at the same voltage as the surface underlying the photoconductor material at input face 26 (−990 volts); thus electron multiplication does not occur in microchannel plate 24, and electrons are not directed to phosphor screen 22 during Phase I.

In Phase II, the potentials of microchannel plate 24 are changed so that the flood electrons can pass into channels 33 that have been opened by middle-infrared radiation incident on the associated photoconductor material. The potentials are changed as indicated in FIG. 4. Film 21 rises in potential 10 volts from −1015 volts to −1005 volts, 5 volts below the potential at anode 32, causing electrons with energy greater than 5 electron volts to collect there, while electrons with less than 5 electron volts energy will be deflected back some point short of film 21 to microchannel plate 24. The 10 volt drop to potential at the surface underlying the photoconductor material at face 26 from −990 volts to −1000 volts causes photoconductor material 27 to also initially drop 10 volts from −1000 volts to −1010 volts, which is 10 volts below anode 32. This lowered potential at photoconductor material 27 prevents any electrons in the region adjacent to input face 26 (which electrons have less than 5 electron volts energy) from passing into channels 33 at the beginning of Phase II. Portions of photoconductor material 27 on which middle-infrared radiation is incident rise in potential during Phase II, and eventually the rise at some portions is such that the electrons have sufficient energy to pass into associated channels 33. During Phase II, output face 29 of microchannel plate 24 is set to 0 volts, and the 1,000 volt potential applied across plate 24 causes electron multiplication to begin in the illuminated channels, and electrons to impinge phosphor screen 22. An image appears on phosphor screen 22, the brightness of the image varying with the level of middle-infrared radiation on photoconductor material 27.

OTHER EMBODIMENTS

Other embodiments of the invention are within the scope of the following claims. For example, other photoconductors that are activated by middle-infrared radiation can be used, and cooling systems need not be used where the photoconductor functions properly at room temperature.

I claim:

1. A middle-infrared image intensifier comprising an image-forming microchannel plate having an input face for receiving a middle-infrared radiation image and an output face, said plate carrying, at entrances to channels of said microchannel plate at said input face, a photoconductor material that is activated by middle-infrared radiation incident on said input face, an electron generator for flooding slow electrons to a region adjacent to said input face of said photoconductor, an electron-sensitive light-emitting screen positioned to receive electrons from said output face of said microchannel plate, and activating means for activating said microchannel plate to provide electrons to, and multiply electrons in, channels of said microchannel plate at which middle-infrared radiation is incident on photoconductor material at entrances thereof, to thereby provide a visible image on said screen of said middle-infrared radiation image.

2. The middle-infrared image intensifier of claim 1 wherein said electron generator includes an anode, and said activating means includes a voltage source for driving the potential at said photoconductor material for all entrances below that of said anode and means for permitting the potential of said photoconductor material to be selectively raised by middle-infrared radiation of said middle-infrared image incident on said photoconductor material a sufficient amount to permit electrons to pass into said channels.

3. The middle-infrared image intensifier of claim 2 wherein said activating means includes means for cyclically activating and deactivating said microchannel plate and means for maintaining the surface underlying said photoconductor material at said input face at a first potential that is higher than that of said anode while said microchannel plate is deactivated to permit electrons collecting on said photoconductor to provide a potential lower than that of said surface of said input face underlying said photoconductor material, and said voltage source includes means for cyclically lowering the potential at said surface underlying said photoconductor material of said input face relative to the potential of said anode while said microchannel plate is activated.

4. The middle-infrared image intensifier of claim 3 wherein said means for permitting includes means for limiting the energy of flooding electrons adjacent to said input face so that they do not have sufficient energy to enter channels at which the potential of the photoconductor material has not been raised.

5. The middle-infrared image intensifier of claim 4 wherein said electron generator includes a channel electron multiplier, and said means for limiting includes a member of said anode positioned to receive electrons from said channel electron multiplier at a surface having high secondary emission characteristics, whereby electrons emitted from said surface leave at a lower energy than those that impinge it.

6. The middle-infrared image intensifier of claim 5 wherein said means for limiting includes means for further limiting the energy of said electrons while said microchannel plate is activated.

7. The middle-infrared image intensifier of claim 6 further comprising an input window, and wherein said means for further limiting includes a film on the inner surface of said input window at a potential higher than the potential of said photoconductor material prior to being raised by middle-infrared radiation.

8. The middle-infrared image intensifier of claim 1 wherein said photoconductor is mercury cadmium telluride, and further comprising a cooling system to maintain said photoconductor at about 80° K.

* * * * *